US006028275A

United States Patent [19]

Jou

[11] Patent Number: 6,028,275

[45] Date of Patent: Feb. 22, 2000

[54] TILT SWITCH

[76] Inventor: Tien-Ming Jou, No. 41, Shan-Hsi-Wu St., N. Dist., Taichung City, Taiwan

[21] Appl. No.: 09/352,326

[22] Filed: Jul. 13, 1999

[51] Int. Cl.[7] ..... H01H 35/14

[52] U.S. Cl. ..... 200/61.52

[58] Field of Search ..... 200/61.45 R–61.45 M

[56] References Cited

U.S. PATENT DOCUMENTS

| | | | |
|---|---|---|---|
| 3,509,298 | 4/1970 | Kirk | 200/61.45 R |
| 3,706,867 | 12/1972 | Rand et al. | 200/61.52 |
| 3,927,286 | 12/1975 | Fohl | 200/61.45 R |
| 4,628,160 | 12/1986 | Canevari | 200/61.45 R |
| 4,833,281 | 5/1989 | Maples | 200/61.45 R |

*Primary Examiner*—Michael Friedhofer
*Attorney, Agent, or Firm*—Nixon & Vanderhye

[57] ABSTRACT

A tilt switch includes an insulating switch body with top and bottom walls and an inner circumferential wall surrounding an upright central axis. An upright electric contact member is secured to the top wall, and extends along the central axis to form a first electric contact terminal outwardly of the bottom wall. An annular electric contact member engages the inner circumferential wall, and has an inner peripheral wall, and an annular rolling surface forming with the inner peripheral wall at the juncture thereof an annular edge. A second electric contact terminal is integrally formed with the annular electric contact member, and extends downwardly and outwardly of the bottom wall. An electrically conductive ball member is disposed in the insulating switch body such that when the annular rolling surface remains in a horizontal plane, the ball member will be retained between the upright electric contact member and the annular edge to establish an electrical connection between the first and second electric contact terminals. Once the annular rolling surface is tilted from the horizontal plane, the change of gravity will move the ball member over the annular edge and away from the upright electric contact member so as to break the electrical connection.

8 Claims, 5 Drawing Sheets

TILT SWITCH

BACKGROUND OF THE INVENTION

1. Field of the Invention

This invention relates to a safety switch, more particularly to a tilt switch with an annular edge to retain contact of a conductive ball member and a conductive contact terminal.

2. Description of the Related Art

Conventional upright electric equipments, such as a floor lamp, generally have an upright elongated rod for supporting a thermal-conductive member at an upper end, which tends to causing undesired tilting of the electric equipment that can lead to danger.

SUMMARY OF THE INVENTION

The object of the present invention is to provide a tilt switch which is adapted to be mounted on an electric equipment and which can electrically break off when it is tilted to deviate from an upright direction. In addition, the tilt switch has an annular edge to retain contact of a conductive ball member and a conductive contact terminal for stabilizing the electric contact therebetween.

According to this invention, the tilt switch includes an insulating switch body with top and bottom walls and an inner circumferential wall extending therebetween in a longitudinal direction and surrounding a central axis parallel to the longitudinal direction. An upright electric contact member has an upper end secured to the top wall, and a lower end fixed on the bottom wall and extending along the central axis. The lower end further extends downwardly and outwardly of the bottom wall to form a first electric contact terminal. An annular electric contact member includes an outer peripheral wall engaging the inner circumferential wall, an inner peripheral wall circumferentially opposite to the outer peripheral wall, and an annular rolling surface interposed therebetween. The annular rolling surface is spaced apart from the top wall with an upright length, and forms with the inner peripheral wall at the juncture thereof an annular edge. A second electric contact terminal is integrally formed with the annular electric contact member, extends downwardly and outwardly of the bottom wall, and is spaced apart from the first electric contact terminal in a direction transverse to the longitudinal direction. An electrically conductive ball member is disposed in the insulating switch body, and has a diameter smaller than both a shortest one of first radial lengths between the upright electric contact member and the inner circumferential wall of the switch body, and the upright length. The ball member further has a radius smaller than a shortest one of second radial lengths between the annular edge and the upright electric contact member.

When the annular rolling surface remains in a horizontal plane, the ball member will be retained between the upright electric contact member and the annular edge to establish an electrical connection between the first and second electric contact terminals. Once the annular rolling surface is tilted from the horizontal plane, the change of gravity will move the ball member over the annular edge and away from the upright electric contact member so as to break the electrical connection between the first and second electric contact terminals.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
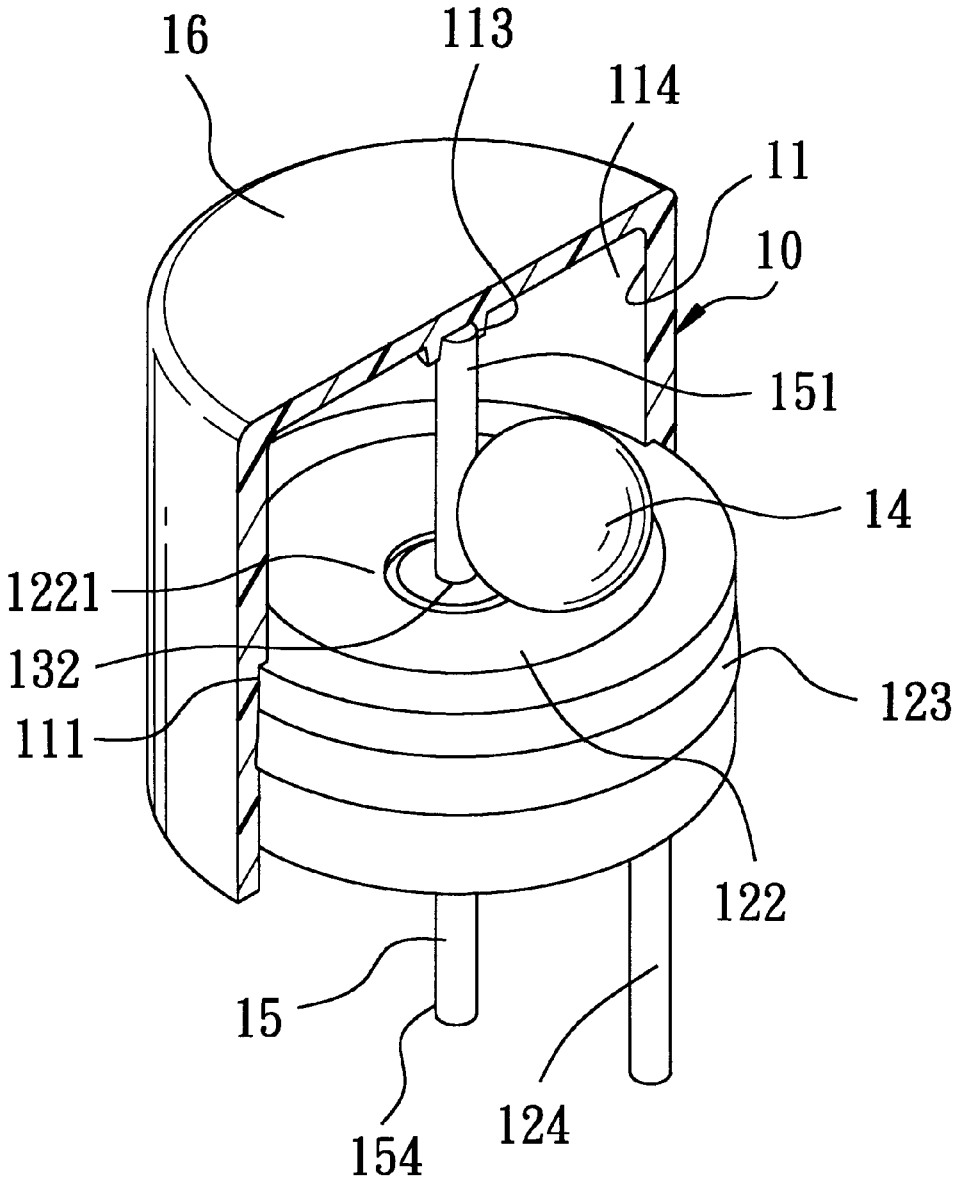
FIG. 1 is a perspective view of a first preferred embodiment of a tilt switch according to this invention with a switch body illustrated in part.

Before the present invention is described in greater detail, it should be noted that same reference numerals have been used to denote like elements throughout the specification.

Figure 2:
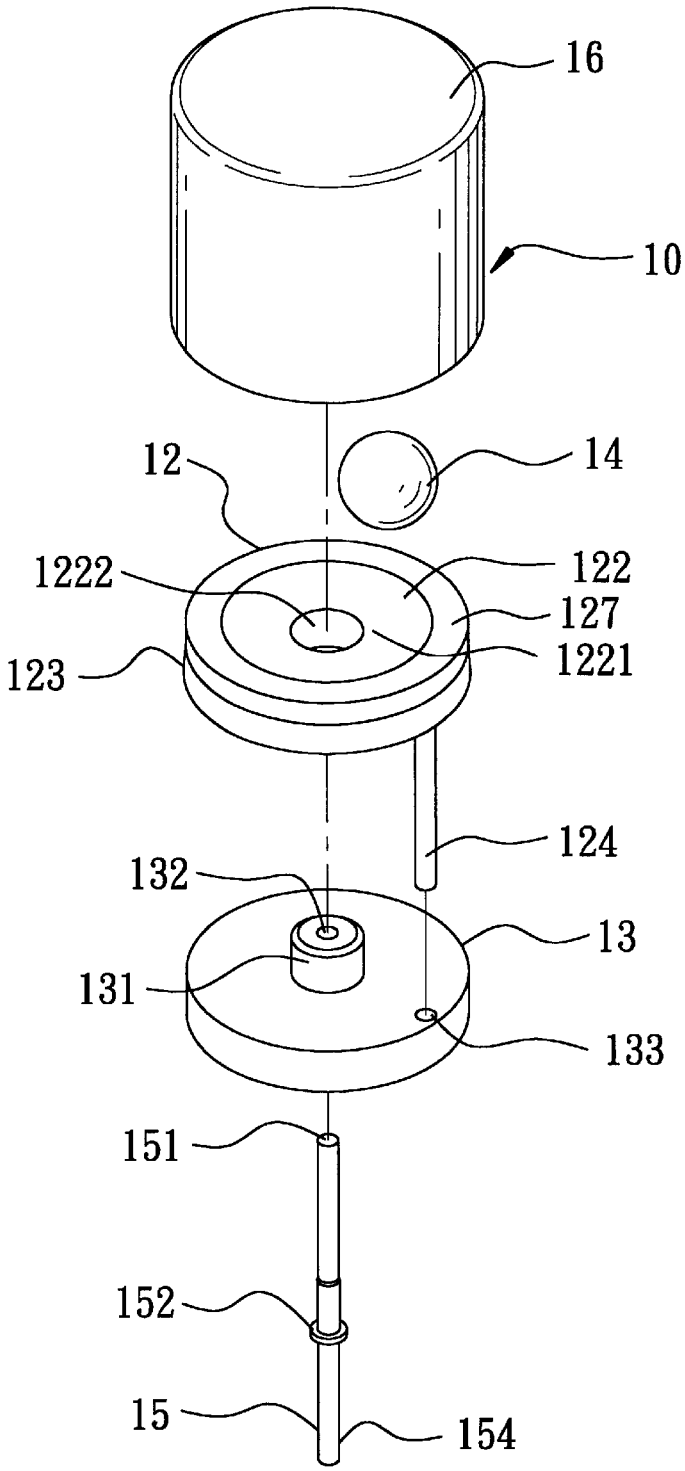
FIG. 2 is an exploded view of the first preferred embodiment.
Figure 3:
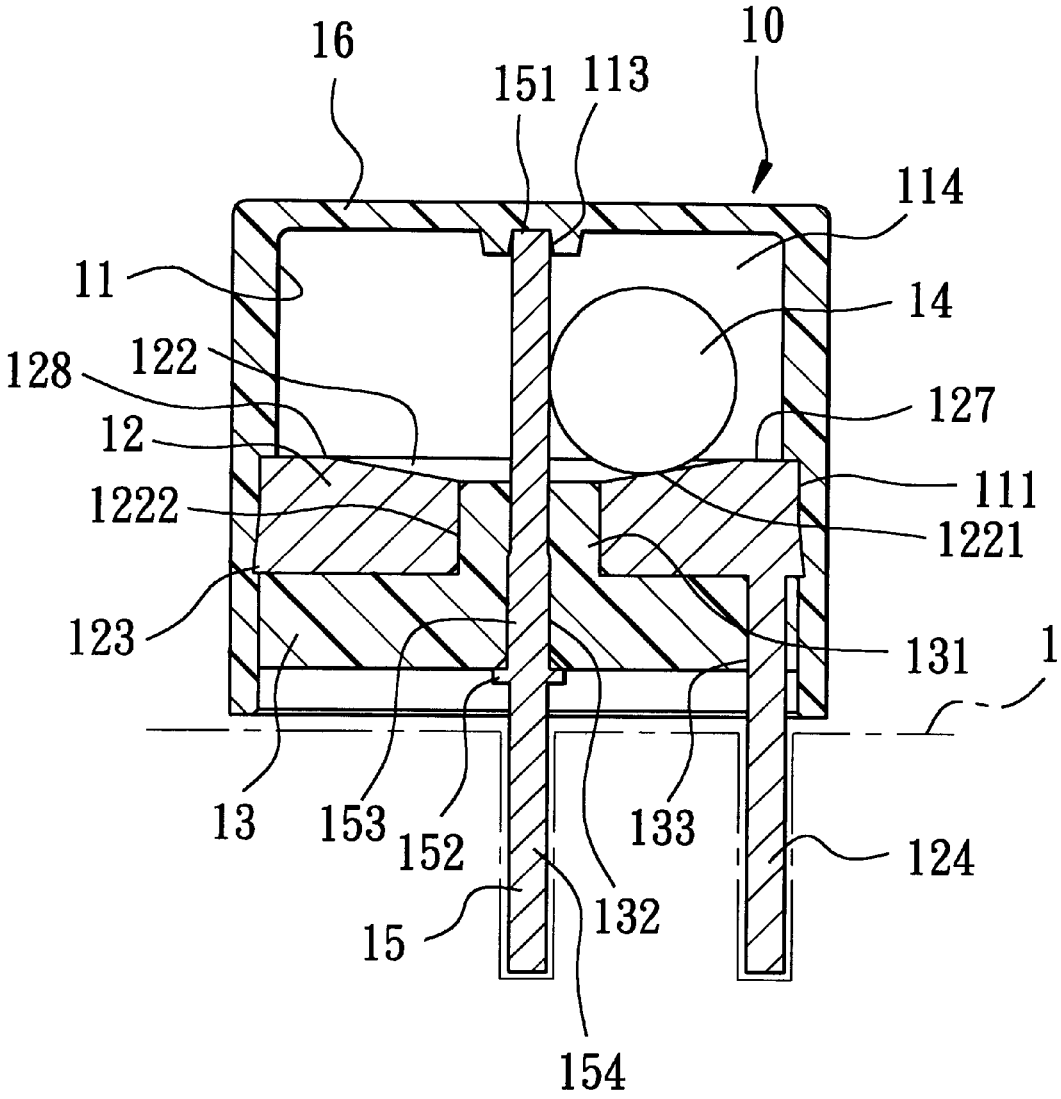
FIG. 3 is a sectional view of the first preferred embodiment.

Referring to FIGS. 1, 2 and 3, the first preferred embodiment of the tilt switch according to the present invention is shown to be adapted to be mounted on and in electric contact with a support 1 in an upright position. The tilt switch is shown to comprise an insulating switch body 10, an upright electric contact member 15, an annular electric contact member 12, a second electric contact terminal 124, and an electrically conductive ball member 14.

The insulating switch body 10 includes top and bottom walls 16,13 which are spaced apart from each other in a longitudinal direction when the tilt switch is in the upright position, and an inner circumferential wall 11 which extends from the top wall 16 to the bottom wall 13 in the longitudinal direction and which spacedly surrounds a central axis parallel to the longitudinal direction. The inner circumferential wall 11 has an annular recess 111. The top wall 16 has an engaging hole 113 which is formed in the central axis. A protrusion 131 extends upwardly from the bottom wall 13 in the longitudinal direction. A mounting hole 132 is defined by an annular inner wall which extends along the central axis through the protrusion 131 and the bottom wall 13.

The upright electric contact member 15 has an upper end 151 which is secured in the engaging hole 113 of the top wall 16, and a lower end 153 which is fixed in the mounting hole 132 and which extends along the central axis. The upright electric contact member 15 defines with the inner circumferential wall 11 of the switch body 10 first radial lengths. The lower end 153 further extends downwardly and outwardly of the bottom wall 13 to form a first electric contact terminal 154 adapted to be mounted on the support 1. In addition, the lower end 153 further has a stop portion 152 extending therefrom in a direction transverse to the longitudinal direction so as to be disposed beneath and abut against the bottom wall 13.

The annular electric contact member 12 includes an outer peripheral wall with an engaging portion 123 for engaging the recess 111 of the insulating switch body 10. An inner peripheral wall 122 is disposed circumferentially opposite to the outer peripheral wall. An annular rolling surface 127 is interposed between the outer peripheral wall and the inner peripheral wall 122, and defines a horizontal plane when the first electric contact terminal 154 is mounted on the support 1. The annular rolling surface 127 is spaced apart from the top wall 16 with an upright length. In addition, the annular rolling surface 127 forms with the inner peripheral wall 122 at the juncture thereof an annular edge 128 which defines with the upright electric contact member 15 second radial lengths. As shown in FIG. 3, in this embodiment, the inner peripheral wall 122 includes a first wall section 1221 which extends inwardly and radially from the annular edge 128 toward the upright electric contact member 15, and which is slightly inclined downwardly, and a second wall section 1222 which extends downwardly in the longitudinal direction from the first wall section 1221 around the central axis, and which engages the protrusion 131 of the insulating switch body 10.

The second electric contact terminal 124 is disposed beneath and is integrally formed with the annular electric contact member 12. The second electric contact terminal 124 extends downwardly and outwardly of the bottom wall 13 via a through hole 133 formed through the bottom wall 13 adjacent to the inner circumferential wall 11 so as to be spaced apart from the first electric contact terminal 154 in the transverse direction in order to be adapted to be mounted on the support 1.

The electrically conductive ball member 14 is disposed movably in a receiving space 114 defined in the insulating switch body 10. The ball member 14 has a diameter smaller than both a shortest one of the first radial lengths between the upright electric contact member 15 and the inner circumferential wall 11 and the upright length between the top wall 16 and the annular rolling surface 127. In addition, the ball member 14 has a radius smaller than a shortest one of the second radial lengths between the annular edge 128 and the upright electric contact member 15.

Figure 4:
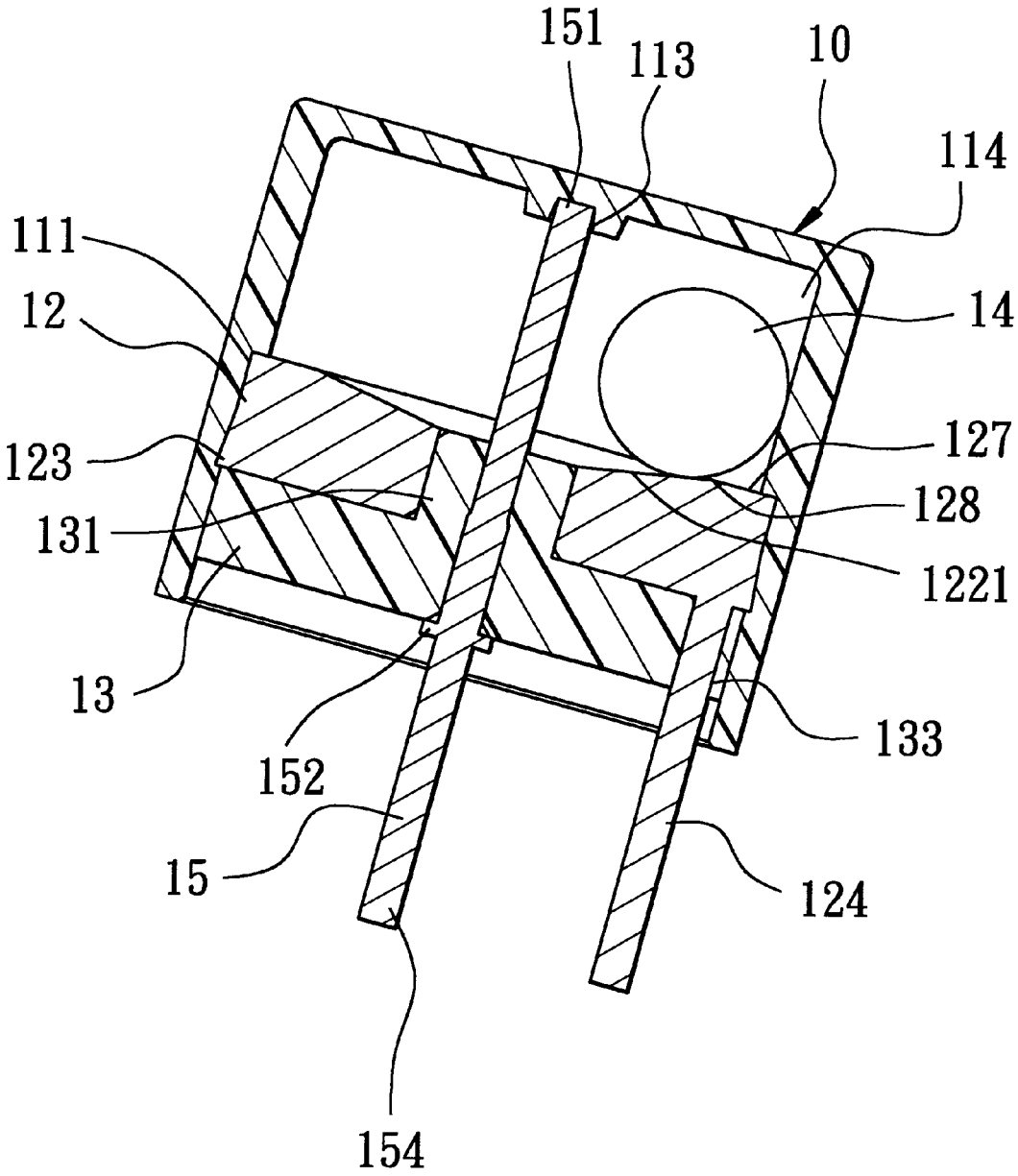
FIG. 4 is a sectional view of the first preferred embodiment in a tilted state.

As mentioned above, as shown in FIG. 3, when the annular rolling surface 127 remains in a horizontal plane, the ball member 14 will be stuck and retained between the upright electric contact member 15 and the annular edge 128 to establish an electrical connection between the first and second electric contact terminals 154,124. As shown in FIG. 4, once the switch body 10 is tilted and deviates from the upright direction, and the annular rolling surface 127 is tilted from the horizontal plane, the change of gravity will move the ball member 14 over the annular edge 128 and away from the upright electric contact member 15 so as to break the electrical connection between the first and second electric contact terminals 154,124.

In assembly, after the ball member 14 is received in the receiving space 114, the assembly of the bottom wall 13 of the switch body 10 and the annular electric contact member 12 is fitted in the recess 111. Then, the upright electric contact member 15 is passed through the mounting hole 132 in the bottom wall 13, and the upper end 151 thereof is secured in the hole 113 in the top wall 16. As such, the tilt switch of this invention has a simple construction that is easy to assemble. Moreover, by virtue of the construction of the annular edge 128, when the switch body 10 stands in line with the upright direction to make electrical connection between the first and second electric contact terminals 154,124, the contact force of the ball member 14 with the upright electric contact member 15 can be reinforced against an unexpected minor jerking force, thereby stabilizing the electrical connection between the first and second electric contact terminals 154,124.

Figure 5:
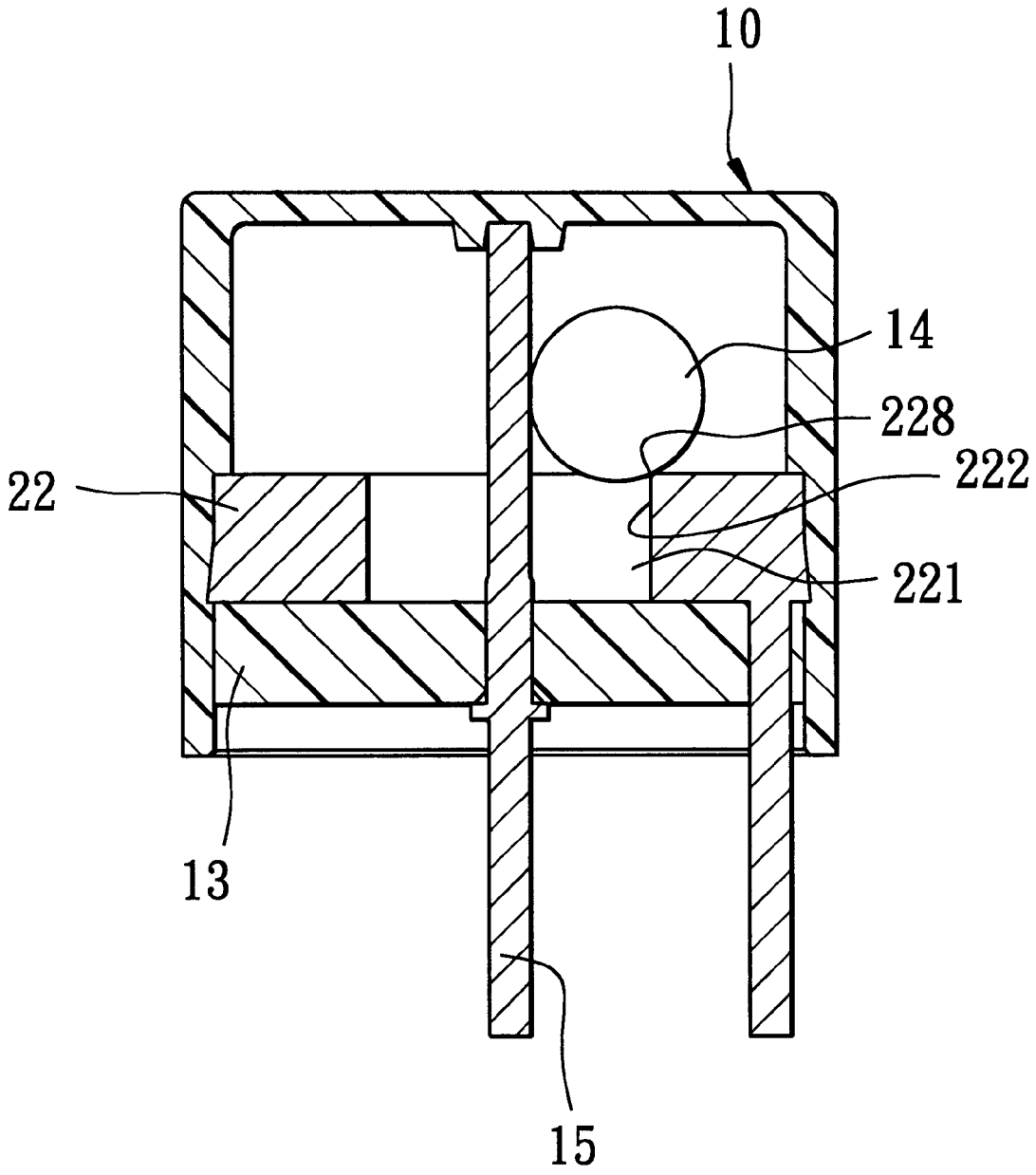
FIG. 5 is a sectional view of a second preferred embodiment of the tilt switch according to this invention.

FIG. 5 shows the second preferred embodiment of the tilt switch according to this invention, which differs from the first preferred embodiment in that the inner peripheral wall 222 of the annular electric contact member 22 extends downwardly in the longitudinal direction from the annular edge 228. In addition, the protrusion is eliminated such that a space 221 is defined by the inner peripheral wall 222 and the upright electric contact member 15 to separate the contact members 15,22.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A tilt switch adapted to be mounted on and in electric contact with a support in an upright position, said tilt switch comprising:

an insulating switch body including top and bottom walls spaced apart from each other in a longitudinal direction when said tilt switch is in the upright position; and an inner circumferential wall extending from said top wall to said bottom wall in the longitudinal direction and spacedly surrounding a central axis parallel to the longitudinal direction;

an upright electric contact member having an upper end secured to said top wall, and a lower end fixed on said bottom wall and extending along the central axis, said upright electric contact member defining with said inner circumferential wall of said switch body first radial lengths, said lower end further extending downwardly and outwardly of said bottom wall to form a first electric contact terminal adapted to be mounted on the support;

an annular electric contact member disposed in said insulating switch body, and including an outer peripheral wall engaging said inner circumferential wall, an inner peripheral wall circumferentially opposite to said outer peripheral wall, and an annular rolling surface interposed between said outer and inner peripheral walls and defining a horizontal plane when said first electric contact terminal is mounted on the support, said annular rolling surface being spaced apart from said top wall with an upright length, said annular rolling surface forming with said inner peripheral wall at the juncture thereof an annular edge which defines with said upright electric contact member second radial lengths;

a second electric contact terminal disposed beneath and integrally formed with said annular electric contact member, said second electric contact terminal extending downwardly and outwardly of said bottom wall, and being spaced apart from said first electric contact terminal in a direction transverse to the longitudinal direction so as to be adapted to be mounted on the support; and an electrically conductive ball member disposed in said insulating switch body, and movable on said annular rolling surface, said ball member having a diameter smaller than both a shortest one of the first radial lengths and the upright length, and a radius smaller than a shortest one of the second radial lengths, whereby, when said annular rolling surface remains in a horizontal plane, said ball member will be retained between said upright electric contact member and said annular edge to establish an electrical connection between said first and second electric contact terminals, and once said annular rolling surface is tilted from the horizontal plane, the change of gravity will move said ball member over said annular edge and away from said upright electric contact member so as to break the electrical connection between said first and second electric contact terminals.

2. The tilt switch as claimed in claim 1, wherein said inner peripheral wall includes a first wall section extending inwardly and radially from said annular edge toward said upright electric contact member and inclining downwardly, and a second wall section extending downwardly in the longitudinal direction from said first wall section around the central axis.

3. The tilt switch as claimed in claim 2, wherein said insulating switch body further has a protrusion extending upwardly from said bottom wall and of a dimension to engage in said second wall section.

4. The tilt switch as claimed in claim 1, wherein said inner peripheral wall of said annular electric contact member extends downwardly in the longitudinal direction from said annular edge.

5. The tilt switch as claimed in claim 1, wherein said bottom wall of said switch body has an annular inner wall portion extending along the central axis for passage of said lower end of said upright electric contact member.

6. The tilt switch as claimed in claim 5, wherein said lower end of said upright electric contact member further has a stop portion extending therefrom in the transverse direction so as to be disposed beneath and abut against said bottom wall when said upper end is secured to said top wall.

7. The tilt switch as claimed in claim 1, wherein said insulating switch body has an annular recess to receive and engage said outer peripheral wall of said annular electric contact member.

8. The tilt switch as claimed in claim 1, wherein said top wall of said insulating switch body has an engaging hole formed in the central axis for engagement with said upper end of said upright electric contact member.

* * * * *